US006273553B1

(12) United States Patent
Kim et al.

(10) Patent No.: US 6,273,553 B1
(45) **Date of Patent: *Aug. 14, 2001**

(54) APPARATUS FOR USING BUBBLES AS VIRTUAL VALVE IN MICROINJECTOR TO EJECT FLUID

(76) Inventors: Chang-Jin Kim, 827 Levering Ave. #709, Los Angeles, CA (US) 90024; Fan-Gang Tseng, 12131 Culver Blvd. #3, Los Angeles, CA (US) 90066; Chih-Ming Ho, 11959 Mayfield Ave. #5, Brentwood, CA (US) 90049

( * ) Notice: Subject to any disclaimer, the term of this patent is extended or adjusted under 35 U.S.C. 154(b) by 0 days.

This patent is subject to a terminal disclaimer.

(21) Appl. No.: 09/535,903

(22) Filed: Mar. 24, 2000

Related U.S. Application Data

(63) Continuation-in-part of application No. 09/235,663, filed on Jan. 22, 1999, now Pat. No. 6,102,530.

(60) Provisional application No. 60/073,293, filed on Jan. 23, 1998.

(51) Int. Cl.[7] ..... B41J 2/14; B41J 2/05; B41J 2/17

(52) U.S. Cl. ..... 347/48; 347/65; 347/94

(58) Field of Search ..... 347/48, 56, 57, 347/67, 92, 94, 58

(56) References Cited

U.S. PATENT DOCUMENTS

| | | | | |
|---|---|---|---|---|
| 4,580,149 | * | 4/1986 | Domoto et al. | 347/61 |
| 5,053,787 | * | 10/1991 | Terasawa | 347/48 |
| 5,479,196 | * | 12/1995 | Inada | 347/92 |
| 5,841,452 | | 11/1998 | Silverbrook . | |

* cited by examiner

*Primary Examiner*—John Barlow
*Assistant Examiner*—Juanita Stephen
(74) *Attorney, Agent, or Firm*—Chan Law Group LC

(57) ABSTRACT

An apparatus and method for forming a bubble within a microchannel of a microinjector to function as a valve mechanism between the chamber and manifold, that provides for a high resistance to liquid exiting the chamber through the manifold during fluid ejection through an orifice and that also provides a low resistance to refilling of liquid into the chamber after ejection of fluid and collapse of the bubble. This effectively minimizes cross talk between adjacent chambers and increases injection frequency of the microinjector. The formation of a second bubble within the chamber coalesces with a first formed bubble between the chamber and manifold to abruptly terminate the ejection of fluid, thereby eliminating satellite droplets.

17 Claims, 6 Drawing Sheets

APPARATUS FOR USING BUBBLES AS VIRTUAL VALVE IN MICROINJECTOR TO EJECT FLUID

CROSS-REFERENCE TO RELATED APPLICATIONS

This application is a continuation of U.S. application Ser. No. 09/235,663, filed on Jan. 22, 1999 now U.S. Pat. No. 6,102,530, which claims priority from U.S. provisional application Ser. No. 60/073,293 filed on Jan. 23, 1998.

STATEMENT REGARDING FEDERALLY SPONSORED RESEARCH OR DEVELOPMENT

This invention was made with Government support under Contract N00014-94-1-0536 awarded by the Office of Naval Research. The Government has certain rights in the invention.

REFERENCE TO A MICROFICHE APPENDIX

Not Applicable

BACKGROUND OF THE INVENTION

1. Field of the Invention

This invention pertains generally to liquid injectors, and more particularly to an apparatus and method for ejecting liquid from a microdevice.

2. Description of the Background Art

Liquid droplet injectors are widely used for printing in inkjet printers. Liquid droplet injectors, however, can also be used in a multitude of other potential applications, such as fuel injection systems, cell sorting, drug delivery systems, direct print lithography, and micro jet propulsion systems, to name a few. Common to all these applications, a reliable and low-cost liquid droplet injector which can supply high quality droplets with high frequency and high spatial resolution, is highly desirable.

Only several devices have the ability to eject liquid droplets individually and with uniform droplet size. Among the liquid droplet injection systems presently known and used, injection by a thermally driven bubble has been most successful of such devices due to its simplicity and relatively low cost.

Thermally driven bubble systems, which are also known as bubble jet systems, suffer from cross talk and satellite droplets. The bubble jet system uses a current pulse to heat an electrode to boil liquid in a chamber. As the liquid boils, a bubble forms in the liquid and expands, functioning as a pump to eject a column of liquid from the chamber through an orifice, which forms into droplets. When the current pulse is terminated, the bubble collapses and liquid refills the chamber by capillary force. The performance of such a system can be measured by the ejection speed and direction, size of droplets, maximum ejection frequency, cross talk between adjacent chambers, overshoots and meniscus oscillation during liquid refilling, and the emergence of satellite droplets. During printing, satellite droplets degrade image sharpness, and in precise liquid control, they reduce the accuracy of flow estimation. Cross talk occurs when bubble jet injectors are placed in arrays with close pitch, and droplets eject from adjacent nozzles.

Most thermal bubble jet systems place a heater at the bottom of the chamber, which loses significant energy to the substrate material. Additionally, bonding is typically used to attach the nozzle plate to its heater plate, which limits nozzle spatial resolution due to the assembly tolerance required. Moreover, the bonding procedure may not be compatible with IC precess, which could be important if the integration of microinjector array with controlling circuit is desired to reduce wiring and to ensure compact packaging.

To solve cross talk and overshoot problems, it has typically been the practice to increase the channel length or adding chamber neck to increase fluid impedance between the chamber and reservoir. However, these practices slow the refilling of liquid into the chamber and greatly reduce the maximum injection frequency of the device.

The most troublesome problem with existing inkjet systems is satellite droplet because it causes image blurring. The satellite droplets that trail the main droplet hit the paper surface at slightly different locations than the main one as the printhead and paper are in relative motion. There is no known effective means or method to solve the satellite droplet problem that is readily available and economical.

Accordingly, there is a need for a liquid droplet injection system that minimizes cross talk without slowing down the liquid refilling rate, thereby maintaining a high frequency response while eliminating satellite droplets, all without adding complexity to the design and manufacturing. The present invention satisfies thess needs, as well as others, and generally overcomes the deficiencies found in the background art.

BRIEF SUMMARY OF THE INVENTION

The present invention pertains to an apparatus and method for forming a bubble within a chamber of a microinjector to function as a valve mechanism between the chamber and manifold, thereby providing high resistance to liquid exiting the chamber to the manifold during fluid ejection through the orifice and also providing a low resistance to refilling of liquid into the chamber after ejection of fluid and collapse of the bubble.

In general terms, the apparatus of the present invention generally comprises a microinjector having a chamber and a manifold in flow communication therethrough, an orifice in fluid communication with the chamber, at least one means for forming a bubble between the chamber and manifold and a means to pressurize the chamber When the bubble is formed at the entrance of the chamber, the flow of liquid out the chamber to the manifold is restricted. The pressurization means, which pressurizes the chamber after formation of the bubble, increases chamber pressure such that fluid is forced out the orifice. After ejection of fluid through the orifice, the bubble collapses and allows liquid to rapidly refill the chamber.

As the chamber is pressurized while the bubble is blocking the chamber from the manifold and adjacent chambers, the cross talk problem is minimized as well.

In the preferred embodiment of the invention, the means for forming the bubble comprises a first heater disposed adjacent the chamber. The pressurization means comprises a second heater capable of forming a second bubble within the chamber. The heaters are disposed adjacent the orifice and comprise an electrode connected in series and having differing resistances due to variations in electrode width. The first heater has a narrower electrode than the second heater, thereby causing the first bubble to form before the second bubble, even when a common electrical signal is applied therethrough.

As the first and second bubble expand, they approach each other and ultimately coalesce, thereby distinctly cutting off the flow of liquid through the orifice and resulting in elimination or significant reduction of satellite droplets.

An object of the present invention is to provide a microinjector apparatus that eliminates satellite droplets.

Another object of the present invention is to provide a microinjector apparatus that minimizes cross talk.

Still another object of the present invention is to provide a microinjector apparatus that allows for the rapid refill of liquid into the chamber after fluid ejection.

Still another object of the present invention is to provide a method for ejecting liquid from a microinjector chamber that minimizes satellite droplets.

Still another object of the present invention is to provide a method for ejecting fluid from a microinjector chamber that minimizes cross talk.

Still another object of the present invention is to provide a method for ejecting fluid from a microinjector chamber that allows for the rapid refill of liquid into the chamber after fluid ejection.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 12. It will be appreciated that the apparatus may vary as to configuration and as to details of the parts without departing from the basic concepts as disclosed herein.

Figure 1:
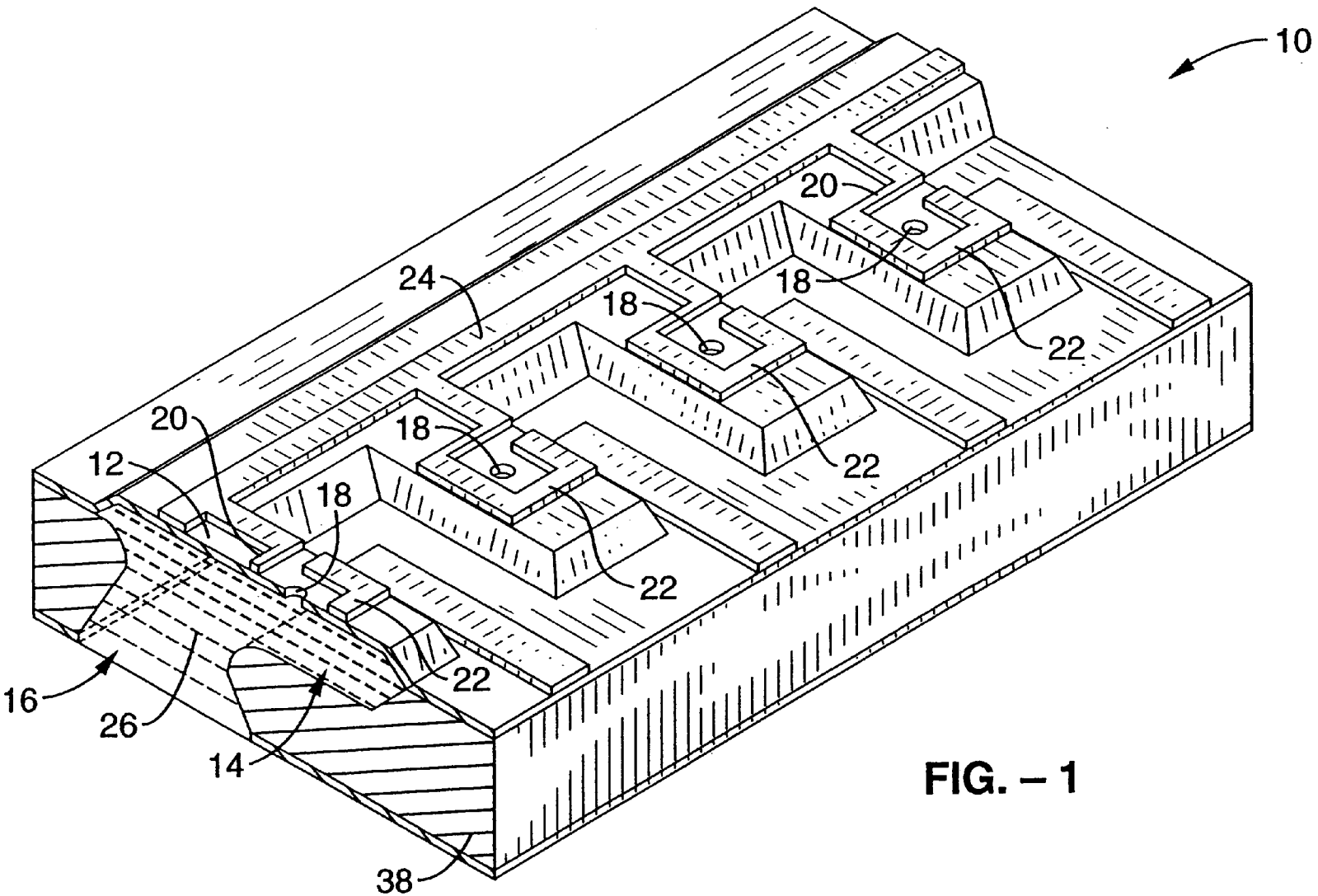
FIG. 1 is a perspective view of a section of a microinjector array apparatus in accordance with the present invention.

Referring first to FIG. 1, an array 10 of a microinjector apparatus 12 is generally shown. Array 10 comprises a plurality of microinjectors 12 disposed adjacent one another. Each microinjector comprises a chamber 14, a manifold 16, an orifice 18, a first heater 20 and a second heater 22. First heater 20 and second heater 22 are typically electrodes connected in series to a common electrode 24.

Figure 2A:
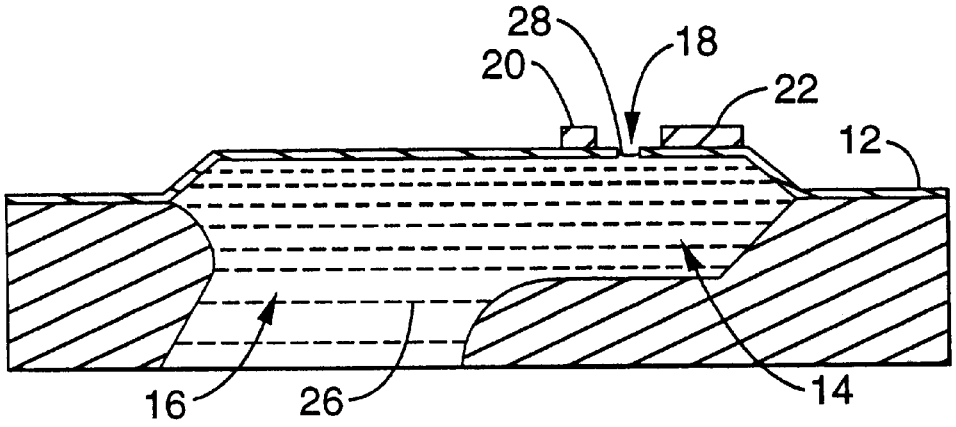
FIG. 2A is a cross-sectional view of a chamber and manifold of the microinjector array apparatus shown in FIG. 1

Referring also to FIG. 2A, chamber 14 is adapted to be filled with liquid 26. Liquid 26 can include, but is not limited to, ink, gasoline, oil, chemicals, biomedical solution, water or the like, depending on the specific application. The meniscus level 28 of liquid 26 generally stabilizes at orifice 18. Manifold 16 is adjacent to and in flow communication with chamber 14. Liquid from a reservoir (not shown) is supplied to chamber 14 by passing through manifold 16. First heater 20 and second heater 22 are situated adjacent orifice 18 and above chamber 14 to prevent heat loss to the substrate. First heater 20 is disposed adjacent manifold 16 while second heater 22 is disposed adjacent chamber 14. As can be seen in FIG. 2A, the cross-section of first heater 20 is narrower than that of second heater 22.

Figure 2B:
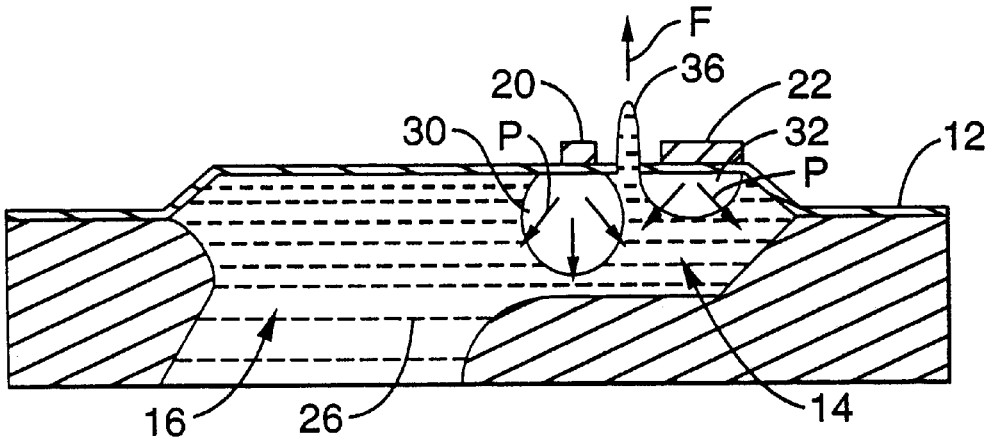
FIG. 2B is a cross-sectional view of a chamber and manifold shown in FIG. 2A illustrating the formation of a first bubble followed by a second bubble to eject fluid out of an orifice.

Referring also to FIG. 2B, since first heater 20 and second heater 22 are connected in series, a common electrical pulse can be used to activate both first heater 20 and second heater 22 simultaneously. Due to first heater 20 having a narrower cross-section there is a higher power dissipation of the current pulse, thereby causing the first heater 20 to heat up more quickly, in response to the common electrical pulse, than second heater 22, which has a wider cross-section. This allows for simplifying the design by eliminating the need for a means to sequentially activate first heater 20 and second heater 22. The activation of first heater causes a first bubble 30 to form between manifold 16 and chamber 14. As first bubble 30 expands in the direction of arrows P, first bubble 30 begins to restrict fluid flow to manifold 16, thereby forming a virtual valve that isolates chamber 14 and shielding adjacent chambers from cross talk. A second bubble 32 is formed under second heater 22 after formation of first bubble 30, and as second bubble 32 expands in the direction of arrows P, chamber 14 is pressurized causing liquid 26 to be ejected through orifice 18 as a liquid column 36 in direction F.

Figure 2C:
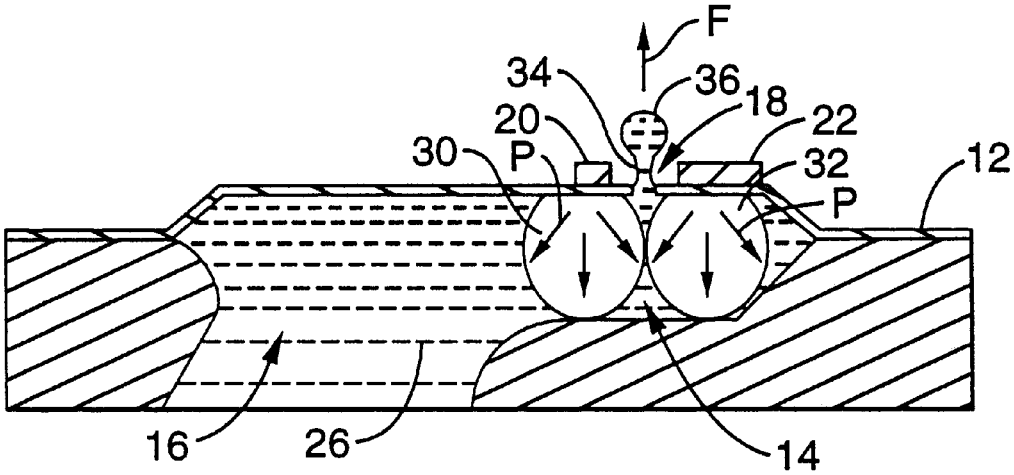
FIG. 2C is a cross-sectional view of a chamber and manifold shown in FIG. 2A illustrating the coalescence of a first and second bubble to terminate ejection of liquid from an orifice.

Referring also to FIG. 2C, as first bubble 30 and second bubble 32 continue to expand, first bubble 30 and second bubble 32 approach each other and terminates ejection of liquid through orifice 18. As first heater 20 and second heater 22 begin to coalesce, the tail 34 of liquid column 36 is abruptly cut off, thereby preventing the formation of satellite droplets.

Figure 2D:
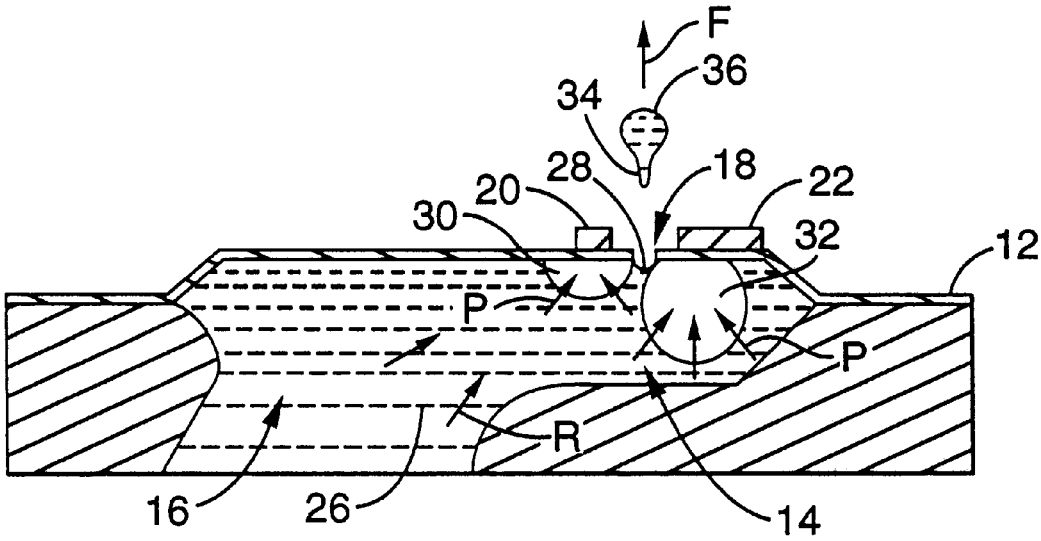
FIG. 2D is a cross-sectional view of a chamber and manifold shown in FIG. 2A illustrating a collapse of a first bubble followed by a second bubble to allow fluid to refill into the chamber.

Referring also to FIG. 2D, termination of the electrical pulse causes first bubble 30 to begin collapsing in the direction shown in P. The near instantaneous collapse of first bubble 30 allows fluid 26 to rapidly refill chamber 14 in the direction shown by arrows R, as there is no more liquid restriction between manifold 16 and chamber 14.

As can be seen therefore, a method for ejecting fluid 26 from a microinjector apparatus 12 in accordance with the present invention, generally comprises the steps of:

(a) generating first bubble 30 in fluid-filled chamber 14 of microinjector apparatus 12;

(b) pressurizing chamber 14 to eject fluid 26 from chamber 14, wherein the pressurizing step comprises generating second bubble 32 in chamber 14;

(c) enlarging first bubble 30 in chamber 14 to serve as a virtual valve for restricting fluid flow between chamber 14 and the manifold 16;

(d) enlarging second bubble 32 in chamber 14, whereby first bubble 30 and second bubble 32 approach each other to abruptly terminate the ejection of fluid from chamber 14; and (e) collapsing first bubble 30 to hasten refill of fluid into chamber 14.

Figure 3:
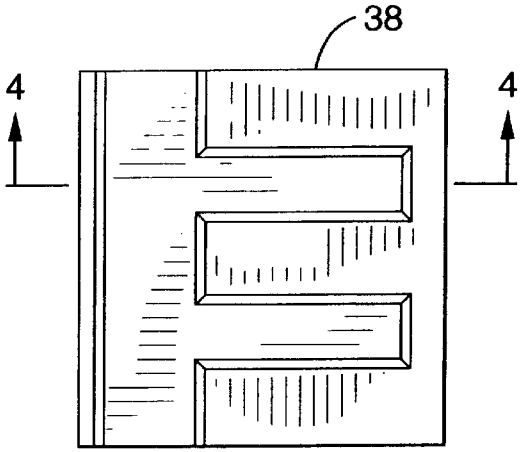
FIG. 3 is a top plan view of a silicon wafer used to fabricate a microinjector array apparatus of the present invention.
Figure 4:
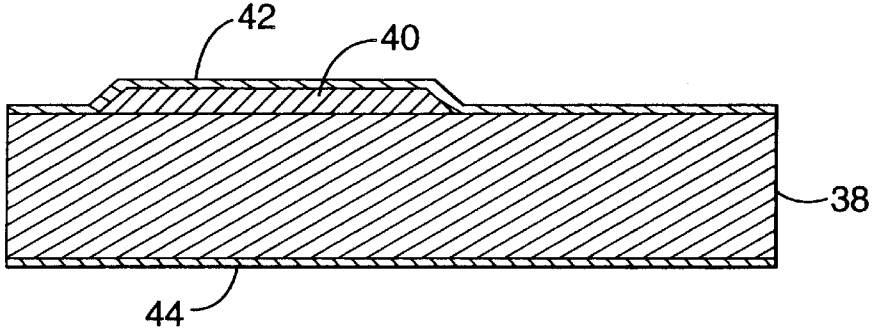
FIG. 4 is a cross-sectional view of a silicon wafer shown in FIG. 3 taken along line 4—4.

Referring also to FIG. 3 and FIG. 4, combined surface and bulk micromachine technology is used to fabricate a microinjector array 10 on a silicon wafer 38 without any wafer bonding process. The manufacturing process begins by depositing and patterning phosphosilicate-glass (PSG) as chamber sacrificial layer 40 and depositing approximately a low-stress silicon nitride 42 as chamber top layer.

Figure 5:
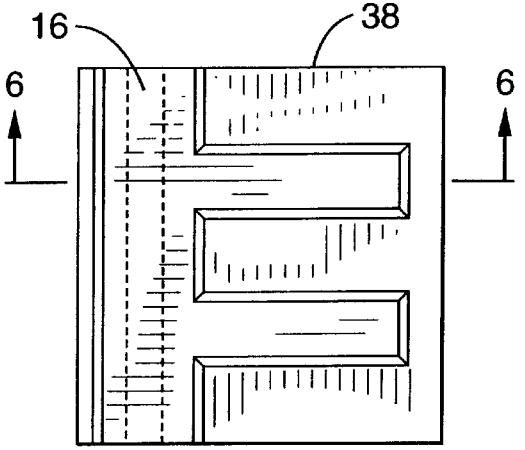
FIG. 5 is a top plan view of a silicon wafer shown in FIG. 3 etched from its backside to form a manifold.
Figure 6:
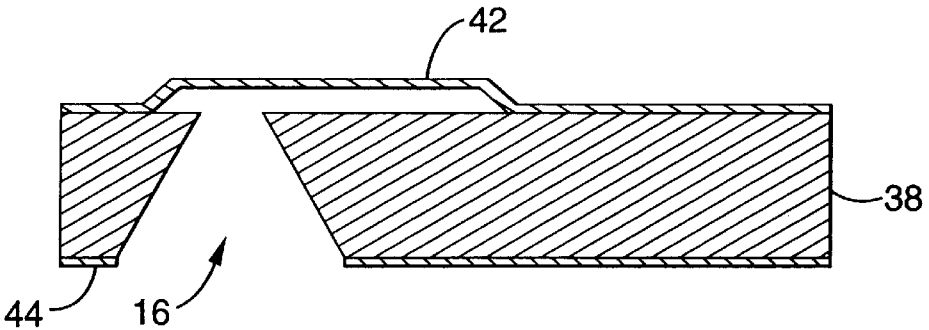
FIG. 6 is a cross-sectional view of a silicon wafer shown in FIG. 5 taken along line 6—6.
Figure 8:
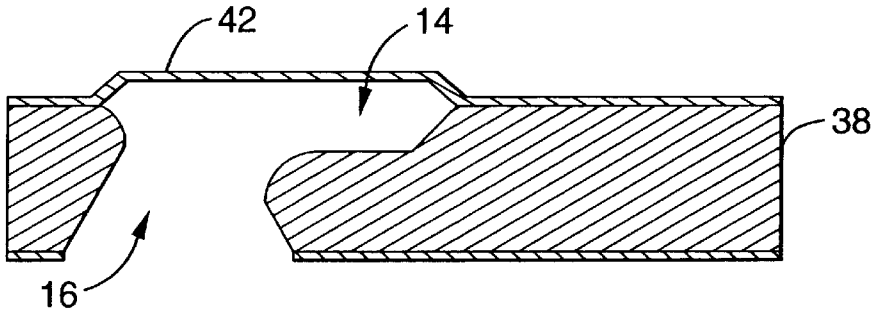
FIG. 8 is a cross-sectional view of a silicon wafer shown in FIG. 7 taken along line 8—8.
Figure 7:
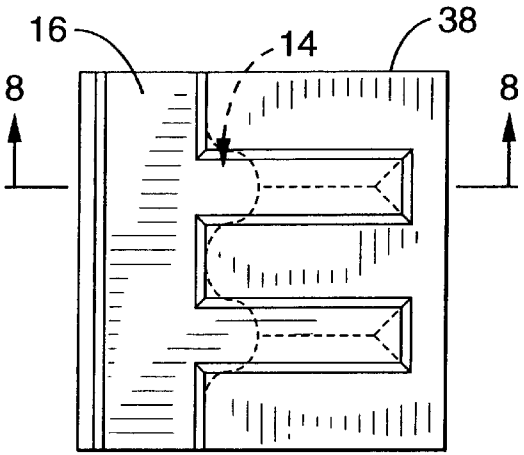
FIG. 7 is a top plan view of a silicon wafer shown in FIG. 5 etched to enlarge the depth of a chamber.

Silicon wafer 38 is then etched from its backside 44, as shown in FIG. 5 and FIG. 6, by potassium hydroxide (KOH) to form manifold 16. The sacrificial PSG layer 40 is removed by hydroflouric acid (HF). As can be seen in FIG. 7 and FIG. 8, another KOH etching enlarges depth of chamber 14 by precise time control. Extra care must be undertaken during this step because the convex corners of chamber 14 are also attacked and rounded.

Figure 10:
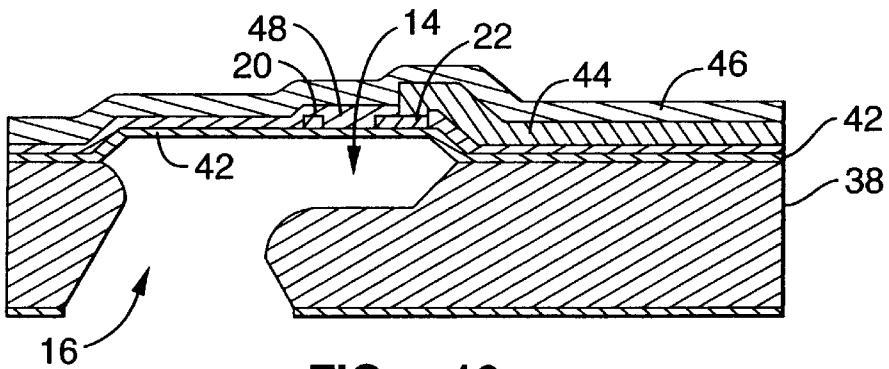
FIG. 10 is a cross-sectional view of a silicon wafer shown in FIG. 9 taken along line 10—10.
Figure 9:
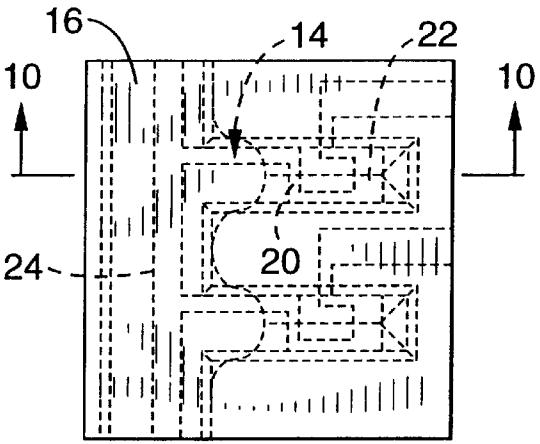
FIG. 9 is a top plan view of a silicon wafer shown in FIG. 7 with heaters deposited and patterned thereon.
Figure 12:
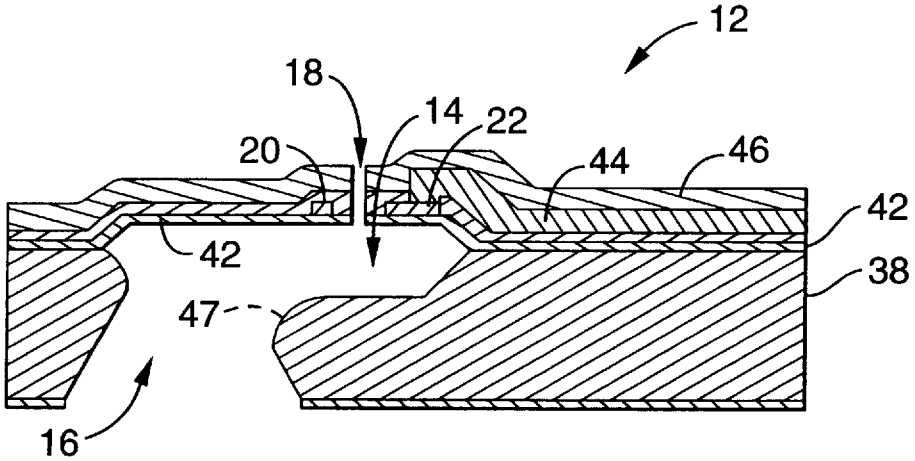
FIG. 12 is a cross-sectional view of a silicon wafer shown in FIG. 11 taken along line 12—12.
Figure 11:
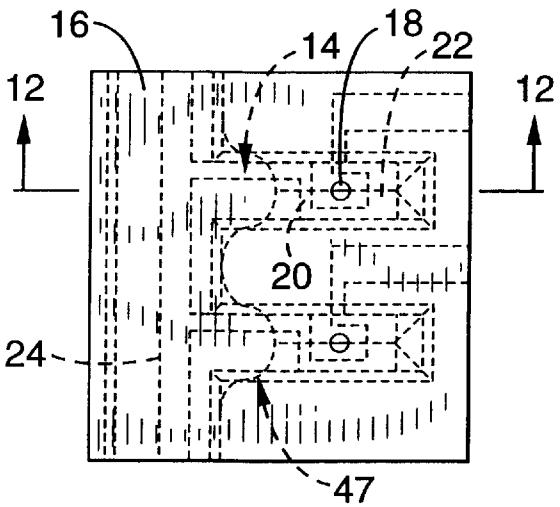
FIG. 11 is a top plan view of a silicon wafer shown in FIG. 9 with an orifice formed.

Referring also to FIG. 9 and FIG. 10, first heater 20 and second heater 22 are deposited and patterned. First heater 20 and second heater 22 are preferably platinum. Metal wires 44 are formed and an oxide layer 46 is deposited on top for passivation. An interconnection 48 between first heater 20 and common electrode 24 is disposed beneath oxide layer 46. Referring finally to FIG. 11 and FIG. 12, orifice 18 is formed. assuming a lithography capability of 3 $\mu$m line width, orifice 18 may be as small as approximately 2 $\mu$m, and the pitch between orifices 18 may be as low as approximately 15 $\mu$m. It can be seen that convex corners 47 of chamber 14 become distinctly defined as a result of the etching.

Accordingly, it will be seen that this invention provides for a novel microinjector that uses a bubble to restrict fluid flow in a microchannel, thereby preventing the escape of liquid from chamber to the manifold during fluid ejection through the orifice. It will also be seen that a second bubble, in conjunction with a first bubble is used to abruptly cut off the liquid column being ejected through the orifice, thereby eliminating satellite droplets. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An apparatus for using a bubble as virtual valve in a microinjector to eject fluid, comprising:

(a) a chamber for containing liquid therein, said chamber including a top layer;

(b) a passivation layer disposed adjacent said top layer;

(c) an orifice in fluid communication with said chamber, said orifice disposed above said chamber and passes through both said passivation layer and said top layer;

(d) means for generating a first bubble in said chamber to serve as a virtual valve when said chamber is filled with liquid, said first bubble generating means disposed proximately adjacent said orifice and between said passivation layer and said top layer; and (e) means for generating a second bubble in said chamber subsequent to generation of said first bubble when said chamber is filled with liquid to eject liquid from said chamber, said second bubble generating means disposed proximately adjacent said orifice and between said passivation layer and said top layer.

2. An apparatus as recited in claim 1, wherein said first bubble generating means comprises a first heater.

3. An apparatus as recited in claim 2, wherein said second bubble generating means comprises a second heater.

4. An apparatus as recited in claim 3, wherein said first heater and said second heater are arranged such that said first bubble and said second bubble expand toward each other to abruptly terminate the ejection of liquid from said chamber.

5. An apparatus as recited in claim 3, wherein said first heater and said second heater are adapted to be driven by a common signal.

6. An apparatus as recited in claim 3, wherein said first heater and said second heater are connected in series.

7. An apparatus as recited in claim 1, wherein generation of said first bubble to serve as a virtual valve, restricts flow of liquid out of said chamber.

8. An apparatus for using bubble as virtual valve in a microinjector to eject liquid, comprising:

(a) a chamber including a top layer disposed thereover;

(b) a passivation layer covering said top layer;

(c) an orifice in flow communication with said chamber;

(d) a first bubble generator disposed proximately adjacent said orifice and embedded between said top layer and said passivation layer; and (e) a second bubble generator disposed proximately adjacent said orifice and embedded between said top layer and said passivation layer, wherein said first bubble generator is adapted to generate a first bubble in said chamber, said first bubble serving as a virtual valve to restrict flow of liquid out of said chamber.

9. An apparatus as recited in claim 8, wherein said first bubble generator comprises a first heater and said second bubble generator comprises a second heater.

10. An apparatus as recited in claim 9, wherein said first heater and said second heater are adapted to be driven by a common signal.

11. An apparatus as recited in claim 9, wherein said first heater and said second heater are connected in series.

12. An apparatus for using bubble as virtual valve in a microinjector to eject liquid, comprising:

a chamber for containing liquid therein, said chamber including a top layer;

an orifice in fluid communication with said chamber, said orifice disposed above said chamber and passes through said top layer;

a first heater having a first power dissipation for generating a first bubble in said chamber to serve as a virtual valve when said chamber is filled with liquid, said first heater disposed proximately adjacent said orifice; and a second heater having a second power dissipation for generating a second bubble in said chamber subsequent to generation of said first bubble when said chamber is filled with liquid to eject liquid from said chamber, said second heater disposed proximately adjacent said orifice and said first power dissipation is substantially higher than said second power dissipation.

13. An apparatus as recited in claim 12, wherein said first heater and said second heater are connected in series.

14. An apparatus as recited in claim 13, wherein said first heater having a first resistance value and said second heater having a second resistance value, said first resistance value is substantially larger than said second resistance value.

15. An apparatus as recited in claim 12, wherein said first heater and said second heater are adapted to be driven by a common signal.

16. An apparatus as recited in claim 12, wherein said first heater and said second heater are arranged such that said first bubble and said second bubble expand towards each other to abruptly terminate the ejection of liquid from said chamber.

17. An apparatus as recited in claim 12, further including a passivation layer disposed adjacent said top layer, said orifice passes through both said passivation layer and said top layer, said first heater and said second heater disposed between said passivation layer and said top layer.

* * * * *